US006702620B2

(12) United States Patent
Lynch et al.

(10) Patent No.: US 6,702,620 B2
(45) Date of Patent: Mar. 9, 2004

(54) DUAL SERIAL ATA CONNECTOR

(75) Inventors: John M. Lynch, Forest Grove, OR (US); John C. Schwartz, Portland, OR (US); Robert Schum, Aloha, OR (US); Endre C. Veka, Portland, OR (US); Thomas G. Ruttan, Lake Oswego, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/945,678

(22) Filed: Sep. 5, 2001

(65) Prior Publication Data

US 2003/0045175 A1 Mar. 6, 2003

(51) Int. Cl.[7] ..... H01R 25/00

(52) U.S. Cl. ..... 439/638; 439/540.1; 439/660; 439/680

(58) Field of Search ..... 439/541.5, 924.1, 439/660, 78, 79, 540.1, 83, 82, 74, 638, 677, 680

(56) References Cited

U.S. PATENT DOCUMENTS 5,145,387 A * 9/1992 Ichihashi ..... 439/108
5,238,414 A * 8/1993 Yaegashi et al. ..... 439/108
5,580,257 A * 12/1996 Harwath ..... 439/108
5,830,018 A * 11/1998 Simmel ..... 439/660
5,842,874 A * 12/1998 Yagi et al. ..... 439/74
6,015,299 A * 1/2000 Walse et al. ..... 439/60
6,238,248 B1 * 5/2001 Ogura et al. ..... 439/660
6,257,933 B1 * 7/2001 Awaji ..... 439/660
6,319,022 B1 * 11/2001 Hwang ..... 439/79
6,331,122 B1 * 12/2001 Wu ..... 439/567
6,489,563 B1 * 12/2002 Zhao et al. ..... 174/88
6,494,749 B1 * 12/2002 Chang ..... 439/701

OTHER PUBLICATIONS

"Serial ATA", Charles M. Kozierok, The PC Guide, pp. 1–2.
"Fast PCs: Can Disk Drives Keep Up?", John G. Spooner, Dec. 12, 2000, pp. 1–3.
"Quantum Drives", Introducing Serial ATA, Nov. 7, 2000, pp. 1–8.
"Serial ATA: High Speed Serialized AT Attachment", Revision 1.0, Aug. 29, 2001, pp. 37–69.
Serial ATA–Enabling the Future.
Serial ATA.
Adam Lecowicz, Serial ATA–The Dawn of a New Era, Oct. 23, 2002.

* cited by examiner

*Primary Examiner*—Ross Gushi
(74) *Attorney, Agent, or Firm*—Antonelli, Terry, Stout & Kraus, LLP

(57) ABSTRACT

A dual serial advanced technology attachment (SATA) connector that includes a first SATA connector interface, a second SATA connector interface, and a housing. The first SATA connector interface and the second SATA connector interface may be mounted in the housing in a double stack configuration parallel to each other. The first SATA connector interface and the second SATA connector interface may also be mounted in the housing longitudinally in an end-to-end configuration. The footprints on a printed circuit board (PCB) associated with the SATA connector interfaces provide less manufacturing problems and good electrical performance. Dual SATA interfaces on a single connector save PCB space and manufacturing assembly time.

28 Claims, 7 Drawing Sheets

DUAL SERIAL ATA CONNECTOR

BACKGROUND

1. Field of the Invention

This invention relates to connectors, and more specifically to dual serial advanced technology attachment (SATA) connectors.

2. Background Information

Currently, most computers have a storage device called a hard drive. A hard drive is connected to the computer by way of an interface, usually a controller card, a cable, and some software protocols. One type of hard drive interface used today is an integrated drive electronics (IDE) interface. This is also known as an advanced technology attachment (ATA) interface. ATA is the actual interface specification for the IDE standard. The current IDE/ATA standard is a parallel interface whereby multiple bits of data are transmitted at one time across the interface simultaneously during each transfer. A parallel interface allows for high throughput, however, as the frequency of the interface is increased, signaling problems and interference between signals become common.

Serial ATA (SATA) is an interface specification that abandons the parallel concept in favor of a serial interface where only one bit is transferred at a time. This allows the interface to operate at higher speeds without the problems associated with a parallel interface at higher speeds. As computer processor performance has increased, so have the read/write data rates of hard disk drive heads and media. Serial ATA eliminates bottlenecks that occur in parallel AT interfaces.

Currently, serial ATA connectors are only single position seven pin connectors. Today, not only are processor speeds increasing, but the amount of space that a computer fits into is shrinking. Therefore, the motherboards or printed circuit boards (PCB) that hold the electronics and other devices for a computer have limited space. In a computer which may contain multiple hard drives, multiple SATA connectors may need to reside on the printed circuit board. This takes up considerable space, depending on the number of hard disk drives and associated SATA connectors.

Therefore, there is a need for a dual serial ATA connector that saves PCB space and simplifies the assembly and manufacturing of the PCB.

BRIEF DESCRIPTION OF THE DRAWINGS

The present invention is further described in the detailed description which follows in reference to the noted plurality of drawings by way of non-limiting examples of embodiments of the present invention in which like reference numerals represent similar parts throughout the several views of the drawings and wherein.

DETAILED DESCRIPTION

The particulars shown herein are by way of example and for purposes of illustrative discussion of the embodiments of the present invention. The description taken with the drawings make it apparent to those skilled in the art how the present invention may be embodied in practice.

Further, arrangements may be shown in block diagram form in order to avoid obscuring the invention, and also in view of the fact that specifics with respect to implementation of such block diagram arrangements is highly dependent upon the platform within which the present invention is to be implemented, i.e., specifics should be well within purview of one skilled in the art. Where specific details (e.g., circuits, flowcharts) are set forth in order to describe example embodiments of the invention, it should be apparent to one skilled in the art that the invention can be practiced without these specific details. Finally, it should be apparent that any combination of hard-wired circuitry and software instructions can be used to implement embodiments of the present invention, i.e., the present invention is not limited to any specific combination of hardware circuitry and software instructions.

Although example embodiments of the present invention may be described using an example system block diagram in an example host unit environment, practice of the invention is not limited thereto, i.e., the invention may be able to be practiced with other types of systems, and in other types of environments.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

The present invention relates to a connector that contains two serial advance technology attachment (SATA) connector interfaces. A double SATA connector according to the present invention offers the advantages of only one connector assembly being required per printed circuit board, and a decrease in assembly time over having to place two individual connectors on the printed circuit board. The present invention may also provide a space savings on a printed circuit board.

Figure 1A:
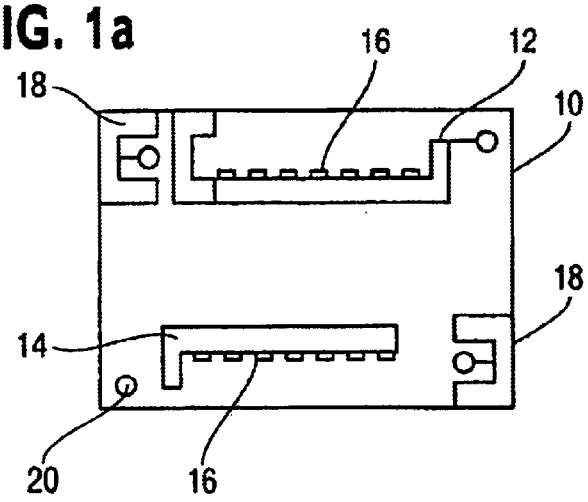
FIGS. 1*a–c* are diagrams of a top view, front view, and right side view, respectively, of a double stack configuration dual SATA connector according to an example embodiment of the present invention.
Figure 1B:
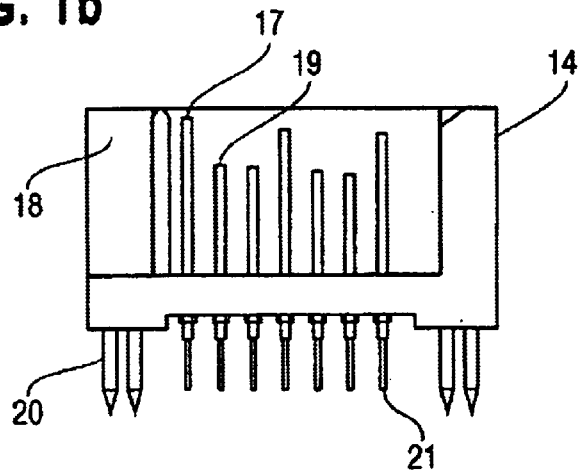
Figure 1C:
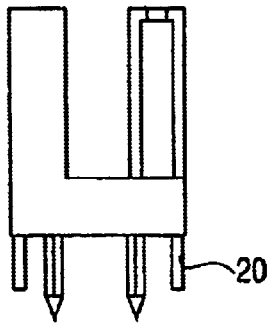

FIGS. 1*a–c* show diagrams of a top view, front view, and right side view, respectively, of a double stack configuration dual SATA connector according to an example embodiment of the present invention. The double stack SATA connector 10 includes two SATA connector interfaces 12 and 14. Each SATA connector interface contains seven pins 16. Connector 10 also may contain one or more keys 18 that help guide a cable assembly onto connector 10. FIG. 1*a* is seen from the perspective of looking from the top down onto connector 10.

From the front view in FIG. 1*b*, the bottom SATA connector interface 14 can be seen along with one of the keys 18. Guide pins 20 may be inserted into a printed circuit board. Guide pins 20 shown in dashed lines denote that the number of guide pins may vary. Pins 16 are shown in FIG. 1*b* as being composed of two types of pins, power/ground pins 17 and signal pins 19. In this through-hole embodiment of the present invention, all pins, 17, 19 have bottom contacts 21 that may be inserted through holes in a printed circuit board. These bottom contacts 21 may be soldered to the printed circuit board along with guide pins 20. Guide pins 20 preferably are metal and provide strength and stability when the bottom contacts 21 are soldered into a printed circuit board. SATA connector interface 12 is not visible from the front view shown in FIG. 1*b*. The view shown in FIG. 1*c* represents the front view shown in FIG. 1*b* rotated 90 degrees.

Figure 2:
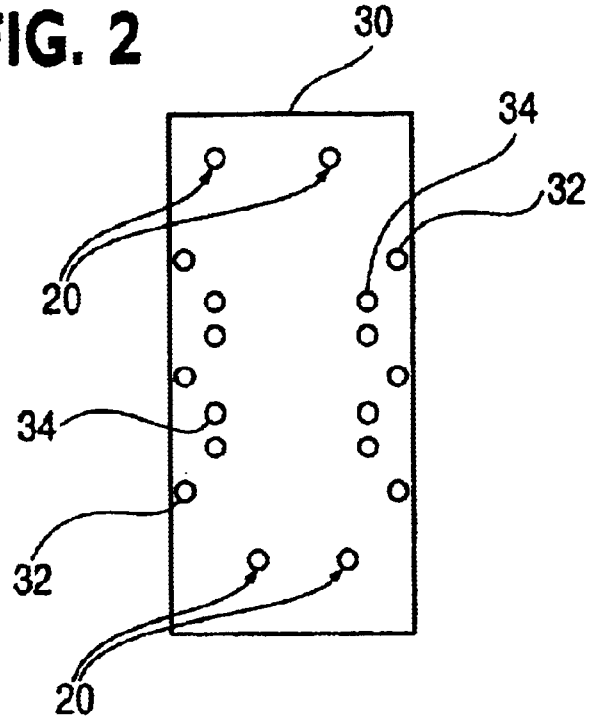
FIG. 2 is a diagram of a footprint pattern for a double stack SATA connector according to an example embodiment of the present invention.

FIG. 2 shows a diagram of a footprint pattern on a PCB for a double stack SATA connector according to an example embodiment of the present invention. This example footprint pattern exists on a printed circuit board and represents a through-hole design where pins from SATA connector interfaces may be inserted through holes, 32, 34 in the pattern on the printed circuit board. The footprint pattern of the holes 34 for signal pins and holes 32 for power/ground pins shown in FIG. 2 provides additional strength and gives more balance to the connector when mounted onto a printed circuit board. The footprint pattern shown in FIG. 2 also has the advantage of cutting down on the risk of bridging during manufacturing.

The seven hole locations on the left side of the footprint shown in FIG. 2 represent where one of the SATA connector interfaces will be placed, and the seven hole locations on the opposite side of the footprint in FIG. 2 shows where the other SATA connector interface may be placed. The holes 32 located to the outside of the footprint pattern on each side, preferably are used for insertion of power/ground pins. The four holes located to the interior from each edge of the footprint shown in FIG. 2 preferably are used for insertion of signal pins. The holes 34 for the signal pins are located towards the inside of the footprint pattern and between the holes 32 for the power/ground pins. Four holes 36, preferably for location/guide pins, are also shown in the footprint pattern. Although four holes are shown, and are shown located at opposite ends of the footprint pattern, any number of holes for guide pins or location pegs, and any position or location of these holes in the footprint is within the spirit and scope of the present invention.

Figure 9:
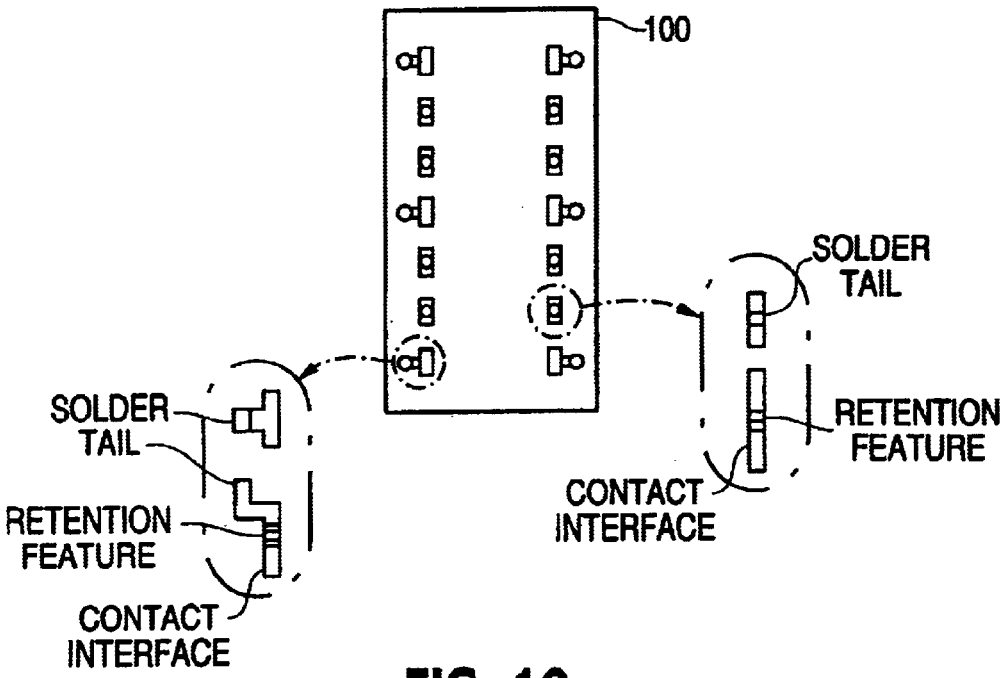
FIG. 9 is a diagram of the bottom side of a double stack SATA connector that may be plugged into the footprint of FIG. 2.

Therefore, the first SATA connector interface may contain first contacts that include first ground contacts located towards the outside of the housing on one side and first signal contacts located towards the inside of the housing and between the first ground contacts. The second SATA connector interface may contain second contacts that include second ground contacts located towards the outside of the housing on an opposite side and second signal contacts located towards the inside of the housing and between the second ground contacts. As stated previously, one connector may be placed on the left side of the footprint shown in FIG. 2 and the other connector placed on an opposite side (right side) of the footprint. FIG. 9 shows a diagram of the bottom side of double stack SATA connector 100 that may be plugged into the footprint of FIG. 2. This shows how the contacts seated in the housing are inline, whereas the solder tails that connect to the footprint may be inline with the contact or off-center from the contact.

Figure 3:
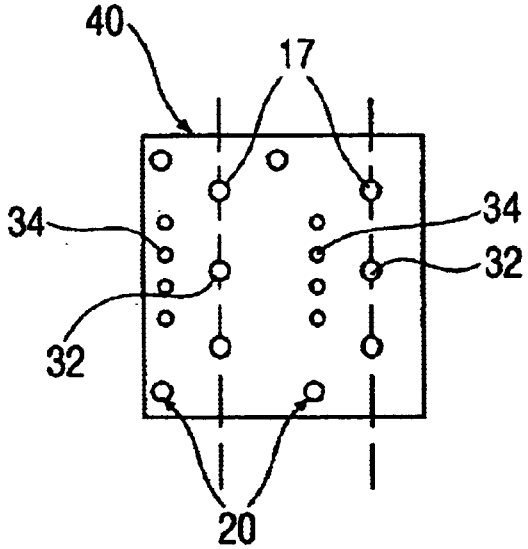
FIG. 3 is a diagram of a footprint pattern for a double stack SATA connector interface according to a second embodiment of the present invention.

FIG. 3 shows a footprint pattern of a double stack SATA connector interface according to a second embodiment of the present invention. In this embodiment, for one of the SATA connector interfaces, the holes 34 for the signal contacts may be located towards the outside edge of the footprint on one side, and the holes 32 for the ground/power contacts located toward the inside of the footprint from holes 34. The second SATA connector interface may have the hole locations 32 for power/ground pins located toward the outside of the footprint pattern on the opposite edge of the side of the holes for the first SATA connector interface. The holes 34 for the signal contacts may be located toward the inside of the footprint from the holes 32 for the power/ground contacts for the second SATA connector interface.

Figure 10:
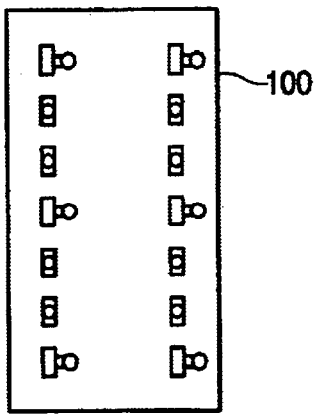
FIG. 10 is a diagram of the bottom side of a double stack SATA connector that may be plugged into the footprint of FIG. 3.

Therefore, the first SATA connector interface may contain first contacts that include first signal contacts located towards the outside of the housing on one side and first ground contacts located towards the inside of the housing from the first ground contacts. The second SATA connector interface may contain second contacts that include second ground contacts located towards the outside of the housing on an opposite side and second signal contacts located towards the inside of the housing and between the second ground contacts. These two connectors may be inserted into the footprint pattern shown in FIG. 3. FIG. 10 shows a diagram of the bottom side of double stack SATA connector 110 that may be plugged into the footprint of FIG. 3.

Although example footprint pattern embodiments have been shown in FIGS. 2 and 3 for SATA connectors, the present invention is not limited to these footprint patterns, and any footprint patterns that supports dual SATA connector interfaces are within the spirit and scope of the present invention.

Figure 4A:
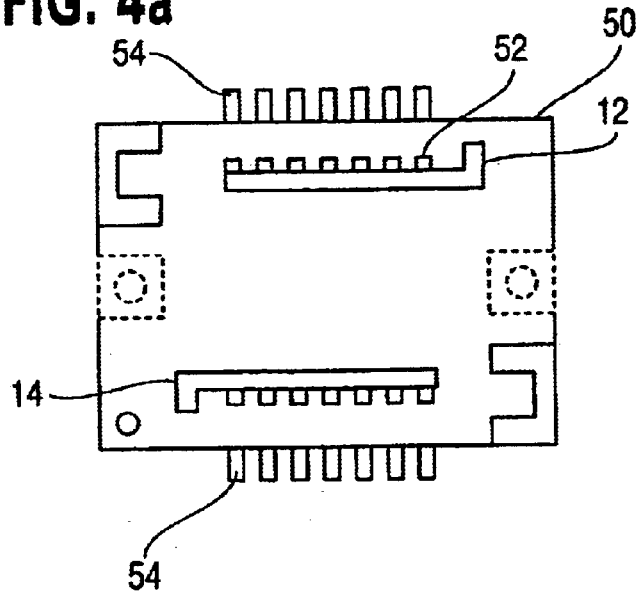
FIGS. 4*a–c* are diagrams of a top view, front view, and right side view, respectively, of a double stack configuration dual SATA connector using surface mount technology according to an example embodiment of the present invention.
Figure 4B:
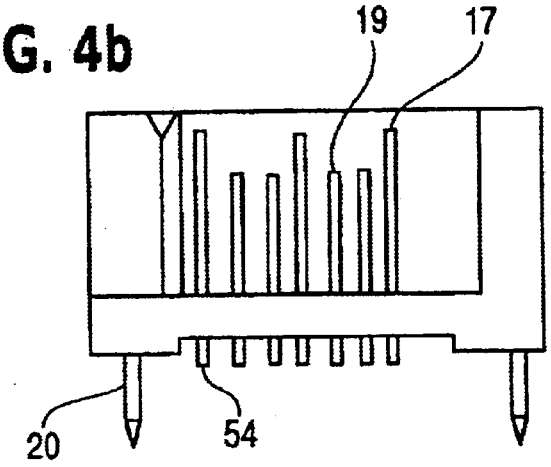
Figure 4C:
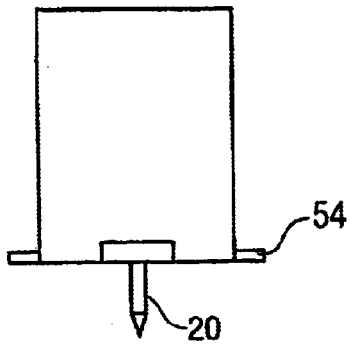

FIGS. 4*a–c* show diagrams of a top view, front view, and right side view, respectively, of a double stack configuration dual SATA connector that uses surface mount technology according to an example embodiment of the present invention. This connector 50 in FIG. 4*a* has two SATA connector interfaces 16 and 14 similar to that shown in FIG. 1. The pins 52 have bottom contact portions 54 for surface mounting of connector 50 onto a printed circuit board. Pins 52 are of two types, signal pins 19 and power/ground pins 17.

FIG. 4*b* shows a front view of a surface mount dual SATA connector. The bottom contacts 54 may be bent and point out of the paper. Guide/locating pegs 20, as noted previously, may be inserted into a printed circuit board for stability. Further, these location pegs may be straight (as shown), or "L" shaped and surface mounted similar to pins 17 and 19.

Figure 5:
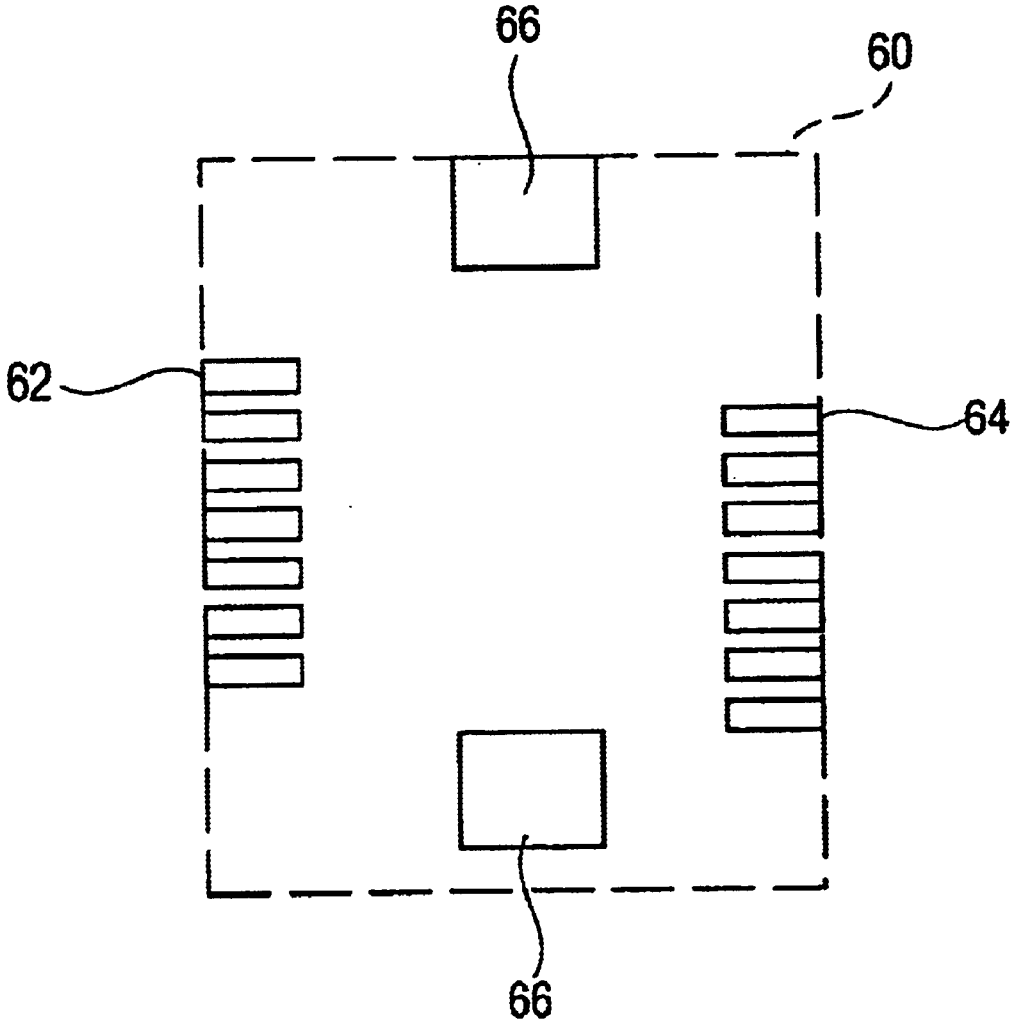
FIG. 5 is a diagram of a footprint for a surface mount dual SATA connector according to another example embodiment of the present invention.

FIG. 5 shows a diagram of a footprint for a surface mount dual SATA connector according to an example embodiment of the present invention. Footprint 60 shows solder pads 62 for one SATA connector interface and solder pads 64 for the second SATA connector interface. Location/guide peg 20 may also be in a form surface mountable to pad 66. Connector 50 shown in FIG. 4*a* may be placed down on footprint 60 and the surface mount contacts 54 soldered onto pads 62 and 64.

Figure 6A:
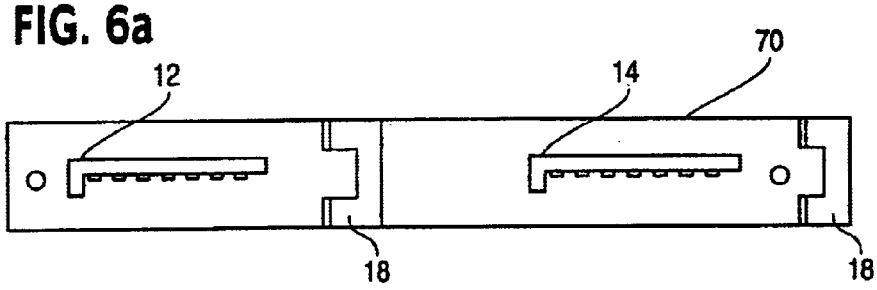
FIGS. 6*a, b* and *c* are diagrams for a top view, front view, and side view, respectively, of a dual SATA connector according to another example embodiment of the present invention.
Figure 6B:
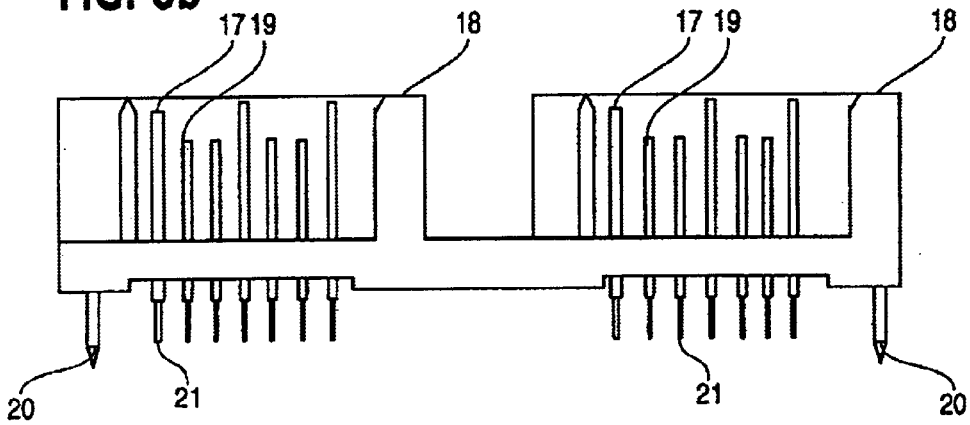
Figure 6C:
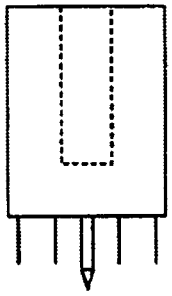
Figure 7:
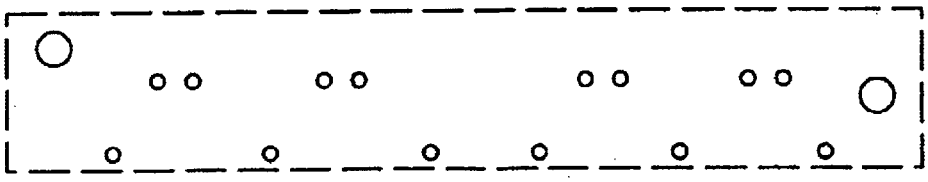
FIG. 7 is a diagram of a footprint pattern for the through-hole example embodiment shown in FIGS. 6*a–c.

FIGS. 6*a, b* and *c* show diagrams for a top view, front view, and side view, respectively, of a dual SATA connector according to another example embodiment of the present invention. In this example embodiment, the two SATA connector interfaces 12, 14 may be mounted on the connector 70 longitudinally in an end-to-end configuration. This configuration may be advantageous for situations where space for connectors on the printed circuit board is limited. The end-to-end configuration connector may fit into narrow areas on the perimeter or in the middle of a printed circuit board that are currently unused. The diagrams shown in FIGS. 6*a–c* is are through hole configurations similar to that of FIGS. 1*a–c*. FIG. 7 shows a diagram of a top view of a footprint pattern for the example embodiment shown in FIGS. 6*a–c*.

Figure 8:
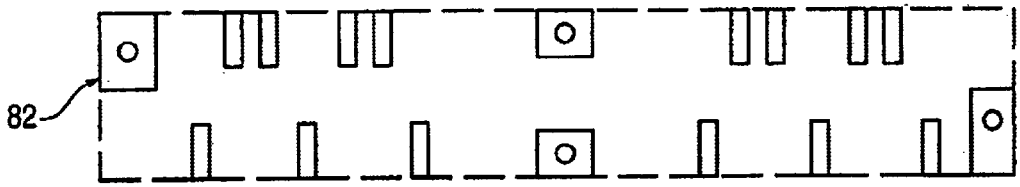
* and FIG. 8 shows a diagram of a footprint pattern for surface mount version of the end-to-end configuration connector shown in FIGS. 6*a–c.*

However, the end-to-end configuration dual SATA connector may be implemented using surface mount technology. FIG. 8 shows a diagram of an example footprint pattern for surface mount version of the end-to-end configuration connector shown in FIGS. 6*a–c*. In this surface mount footprint pattern, the pads for signals pins 19 may be all located on one side of the footprint, and the pads for the ground/power pins 17 located on the opposite side of the footprint. Further, the pads for the signal pins may lie between the pads for the power/ground pins. Location/guide peg 20 may also be in a form surface mountable to pad 82. This pattern has the advantage of being the best electrical pattern for an end-to-end dual SATA connector. This pattern also provides additional support for the connector once mounted. However, the present invention is not limited by this arrangement of pads, and any arrangement of pads that supports a dual SATA connector interface is within the spirit and scope of the present invention.

It is noted that the foregoing examples have been provided merely for the purpose of explanation and are in no way to be construed as limiting of the present invention. While the present invention has been described with reference to a preferred embodiment, it is understood that the words that have been used herein are words of description and illustration, rather than words of limitation. Changes may be made within the purview of the appended claims, as presently stated and as amended, without departing from the scope and spirit of the present invention in its aspects. Although the present invention has been described herein with reference to particular methods, materials, and embodiments, the present invention is not intended to be limited to the particulars disclosed herein, rather, the present invention extends to all functionally equivalent structures, methods and uses, such as are within the scope of the appended claims.

What is claimed is:

1. A dual connector comprising:

a first 7-pin connector interface;

a second 7-pin connector interface; and a housing, wherein the first 7-pin connector interface and the second 7-pin connector interface are mounted in the housing in a double stack configuration adjacent and parallel to each other.

2. The connector according to claim 1, further comprising at least one key attached to the housing, the at least one key guiding a cable assembly onto the connector.

3. The connector according to claim 1, wherein the first 7-pin connector interface and the second 7-pin connector interface contain contacts comprising an upper portion and a lower portion, the lower portion of the contacts being insertable through holes in a printed circuit board.

4. The connector according to claim 1, wherein the first 7-pin connector interface and the second 7-pin connector interface contain contacts comprising an upper portion and a lower portion, the lower portion of the contacts being attachable to a printed circuit board in a surface mount manner.

5. The connector according to claim 1, wherein the first 7-pin connector interface contains first contacts comprising first ground contacts located towards the outside of the housing on one side and first signal contacts located towards the inside of the housing and between the first ground contacts, the second 7-pin connector interface containing second contacts comprising second ground contacts located towards the outside of the housing on an opposite side and second signal contacts located towards the inside of the housing and between the second ground contacts.

6. The connector according to claim 1, wherein the first 7-pin connector interface contains first contacts comprising first signal contacts located towards the outside of the housing on one side and first ground contacts located towards the inside of the housing from the first ground contacts, the second 7-pin connector interface containing second contacts comprising second ground contacts located towards the outside of the housing on an opposite side and second signal contacts located towards the inside of the housing and between the second ground contacts.

7. The connector according to claim 1, further comprising at least one guide, the at least one guide attachable to a printed circuit board when the connector is attached to the printed circuit board, the at least one guide providing added strength and stability to the connector attachment.

8. The connector according to claim 7, wherein the at least one guide is metal.

9. The connector according to claim 7, wherein each at least one guide comprises a pin attachable to the printed circuit board by insertion through holes in the printed circuit board.

10. The connector according to claim 7, wherein each at least one guide is attachable to the printed circuit board in a surface mount manner.

11. A dual connector comprising:

a first 7-pin connector interface;

a second 7-pin connector interface; and a housing, wherein the first 7-pin connector interface and the second 7-pin connector interface are mounted in the housing longitudinally in an end to end configuration.

12. The connector according to claim 11, further comprising at least one key attached to the housing, the at least one key guiding a cable assembly onto the connector.

13. The connector according to claim 11, wherein the first 7-pin connector interface and the second 7-pin connector interface contain contacts comprising an upper portion and a lower portion, the lower portion of the contacts being insertable through holes in a printed circuit board.

14. The connector according to claim 11, wherein the first 7-pin connector interface and the second 7-pin connector interface contain contacts comprising an upper portion and a lower portion, the lower portion of the contacts being attachable to a printed circuit board in a surface mount manner.

15. The connector according to claim 11, wherein the first 7-pin connector interface contains first contacts comprising first ground contacts located towards the outside of the housing on a first side and first signal contacts located towards the outside of the housing on a second side opposite the first side and between the first ground contacts, the second 7-pin connector interface containing second contacts comprising second ground contacts located towards the outside of the housing on the first side and second signal contacts located towards the outside of the housing on the second side opposite the first side and between the second ground contacts.

16. The connector according to claim 11, wherein the first 7-pin connector interface contains first contacts comprising first ground contacts located towards the outside of the housing on a first side and first signal contacts located towards the outside of the housing on a second side opposite the first side and between the first ground contacts, the second 7-pin connector interface containing second contacts comprising second ground contacts located towards the outside of the housing on the second side and second signal contacts located towards the outside of the housing on the first side opposite the second side and between the second ground contacts.

17. The connector according to claim 11, further comprising at least one guide, the at least one guide attachable to a printed circuit board when the connector is attached to the printed circuit board, the at least one guide providing added strength and stability to the connector attachment.

18. The connector according to claim 17, wherein the at least one guide is metal.

19. The connector according to claim 17, wherein each at least one guide comprises a pin attachable to the printed circuit board by insertion through holes in the printed circuit board.

20. The connector according to claim 17, wherein each at least one guide is attachable to the printed circuit board in a surface mount manner.

21. A footprint for a dual connector comprising:

a first set of contact locations for a first 7-pin connector interface; and a second set of contact locations for a second 7-pin connector interface, the second set of contact locations being adjacent and parallel to the first set of contact locations in the footprint.

22. The footprint according to claim 21, wherein the first set of contact locations comprise outside contact locations located towards the outside of the footprint on a first side and inside contact locations located towards the inside of the footprint from the first side and between the outside contact locations, the second set of contact locations comprising second outside contact locations located towards the outside of the footprint on a second side opposite the first side and second inside contact locations located towards the inside of the footprint from the second side and between the second outside contact locations.

23. The footprint according to claim 21, wherein the first set of contact locations and the second set of contact locations contain holes for pins from the first 7-pin connector interface and the second 7-pin connector interface respectively.

24. The footprint according to claim 21, wherein the first set of contact locations and the second set of contact locations contain pads for surface mounting of the first 7-pin connector interface and the second 7-pin connector interface respectively.

25. A footprint for a dual connector comprising:

a first set of contact locations for a first 7-pin connector interface; and a second set of contact locations for a second 7-pin connector interface, the second set of contact locations being located longitudinally to the first set of contact locations in the footprint in an end to end configuration.

26. The footprint according to claim 25, wherein the first set of contact locations comprise outside contact locations located towards the outside of the footprint on a first side and second outside contact locations located towards the outside of the footprint on a second side opposite from the first side, the second set of contact locations comprising third outside contact locations located towards the outside of the footprint on the first side and fourth outside contact locations located towards the outside of the footprint on the second side opposite from the first side.

27. The footprint according to claim 25, wherein the first set of contact locations and the second set of contact locations contain holes for pins from the first 7-pin connector interface and the second 7-pin connector interface respectively.

28. The footprint according to claim 25, wherein the first set of contact locations and the second set of contact locations contain pads for surface mounting of the first 7-pin connector interface and the second 7-pin connector interface respectively.

* * * * *